US007633468B2

(12) United States Patent
Baek

(10) Patent No.: US 7,633,468 B2
(45) Date of Patent: Dec. 15, 2009

(54) IMAGE PROCESSING APPARATUS AND METHOD OF PLASMA DISPLAY PANEL

(75) Inventor: Seung Chan Baek, Seoul (KR)

(73) Assignee: LG Electronics Inc., Seoul (KR)

( * ) Notice: Subject to any disclaimer, the term of this patent is extended or adjusted under 35 U.S.C. 154(b) by 669 days.

(21) Appl. No.: 11/319,464

(22) Filed: Dec. 29, 2005

(65) Prior Publication Data

US 2006/0152441 A1 Jul. 13, 2006

(30) Foreign Application Priority Data

Jan. 13, 2005 (KR) ..... 10-2005-0003478

(51) Int. Cl.
*G09G 3/28* (2006.01)

(52) U.S. Cl. ..... 345/60; 345/63; 345/690; 315/169.4

(58) Field of Classification Search ..... 345/60–63, 345/68, 90, 690; 315/169.4; 358/3.03
See application file for complete search history.

(56) References Cited

U.S. PATENT DOCUMENTS 6,614,413 B2 * 9/2003 Tokunaga et al. ..... 345/63
6,671,068 B1 * 12/2003 Chang et al. ..... 358/1.9
6,697,169 B1 * 2/2004 Feng et al. ..... 358/3.04
2002/0018030 A1 * 2/2002 Shigeta et al. ..... 345/60
2003/0174103 A1 * 9/2003 Choi ..... 345/60
2003/0193451 A1 * 10/2003 Kimura ..... 345/60
2003/0193679 A1 * 10/2003 Iwasaki et al. ..... 358/1.9
2004/0066356 A1 * 4/2004 Yun et al. ..... 345/60
2004/0125117 A1 * 7/2004 Suzuki et al. ..... 345/690
2004/0257306 A1 * 12/2004 Choi ..... 345/60
2005/0078060 A1 * 4/2005 Shigeta et al. ..... 345/63
2007/0206245 A1 * 9/2007 Iwasaki et al. ..... 358/518

* cited by examiner

*Primary Examiner*—Amare Mengistu
*Assistant Examiner*—Hong Zhou
(74) *Attorney, Agent, or Firm*—Birch, Stewart, Kolasch & Birch, LLP

(57) ABSTRACT

This document relates to a display apparatus, and more particularly, to an image processing apparatus and method of a plasma display panel. An image processing apparatus of a plasma display panel according to an embodiment of the present invention comprises an inverse gamma correction unit that gamma-corrects an image signal through previous stored gamma data, a half-toning unit that adds an error diffusion error value (Ei) of neighboring pixels to a noise value (n(i, j)) of a predetermined pattern and diffuses the added result into the inverse gamma corrected image signal, and a sub-field mapping unit that maps the half-toned image signal to a sub-field mapping table.

8 Claims, 4 Drawing Sheets

IMAGE PROCESSING APPARATUS AND METHOD OF PLASMA DISPLAY PANEL

This Nonprovisional application claims priority under 35 U.S.C. § 119(a) on Patent Application No. 10-2005-0003478 filed in Korea on Jan. 13, 2005 the entire contents of which are hereby incorporated by reference.

BACKGROUND OF THE INVENTION

1. Field of the Invention

This document relates to a display apparatus, and more particularly, to an image processing apparatus and method of a plasma display panel.

2. Background of the Related Art

In general, a plasma display apparatus comprises a plasma display panel, i.e., a light-emitting device. The plasma display apparatus is called a flat display apparatus that displays a motion picture or a still image using a gas discharge phenomenon within the plasma display panel.

In the plasma display panel, a plurality of first and second sustain electrode lines and address electrode lines are formed in upper and lower glass substrates, respectively. The entire screen is divided into a plurality of cells by means of the respective electrode lines. Images are displayed by an address discharge and a sustain discharge that selectively occur within each cell.

The term "address discharge" refers to a discharge between the address electrode and the sustain electrode, and the term "sustain discharge" refers to a discharge between the first and second sustain electrodes. The sustain discharge functions to sustain an address discharge.

FIG. 1 is a schematic view illustrating a general plasma display apparatus. As shown in FIG. 1, a plasma display panel 10 comprises 640 R (Red), G (Green) and B (Blue) address electrode lines R1, G1, B1, . . . , R640, G640, B640 (hereinafter referred to as "vertical electrode lines"), and 480 first and second sustain electrode line pairs S1, S2, . . . , S479, S480 (hereinafter referred to as "horizontal electrode lines).

A microcomputer 20 digitizes externally input R, G and B image data and outputs 8-bit R, G and B digital image data (implement 256 gray levels). The microcomputer 20 also outputs various control signals necessary to drive the plasma display panel 10 according to the digital image data and an external signal.

A scan and sustain driver 30 supplies the 480 horizontal electrode lines S1 to S480 with a scan pulse and sequentially scans the 480 horizontal electrode lines one by one, according to the control signal of the microcomputer 20. The scan and sustain driver 30 then supplies the entire horizontal electrode lines S1 to S480 with a sustain pulse in order to sustain a discharge and emission of each cell.

The scan and sustain driver 30 comprises a clock and data generator 31 that generates a clock signal (CLK) and a data signal (DO) according to the control signal of the microcomputer 20, a sustain pulse generator 32 that generates the sustain pulse according to the control signal of the microcomputer 20, and a driving Integrated Circuit (IC) 33 connected to the 480 horizontal electrode lines S1 to S480, for sequentially supplying the scan pulses to the 480 horizontal electrode lines S1 to S480 and then supplying the sustain pulse to them at the same time, according to the clock signal (CLK), the data signal (DO) and a sustain pulse.

A memory unit 40 stores the R, G and B digital image data, which are output from the microcomputer 20, on a frame basis, a color basis and a bit basis. An address driver 50 reads bit values of 640 R, G and B digital image data corresponding to the horizontal electrode lines scanned by the scan and sustain driver 30 from the memory unit 40, and supplies the read bit values to the 640 R, G and B vertical electrode lines R1 to B640.

Meanwhile, a method of driving the plasma display apparatus can be mainly classified into a sub-field driving method and a sub-frame driving method. A process in which the plasma display apparatus constructed above displays an image of 256 gray levels on the plasma display panel screen in accordance with the sub-field driving method will be described below.

In the sub-field driving method, to implement $2^x$ gray levels, one frame screen is displayed with it being divided into X sub-field screens. Externally input image data are digitized into X-bit digital image data and then supplied to the plasma display panel.

Furthermore, each sub-field screen consists of a reset period, an address period and a sustain period. Of them, the reset period and the address period are allocated in the same manner every sub-field, but the sustain period is differently allocated depending on bit weight of digital image data displayed in the address period. Therefore, gray levels of an image can be implemented through a combination of the respective sub-fields (using an eye's integral effect).

That is, as shown in FIG. 2, one frame is divided into eight sub-fields (SF1 to SF8). If a luminance value corresponding to 128:64:32:16:8:4:2:1 is made to correspond to each sub-field, an image corresponding to gray level data 0 to 255 can be displayed through a combination of several sub-fields.

Therefore, the microcomputer 20 digitizes the externally input R, G and B image data in order to implement 256 gray levels, outputs 8-bit R, G and B digital image data (the highest bit value B1 to the lowest bit value B8). The microcomputer 20 also outputs various control signals necessary to drive the plasma display panel 10 according to the digital image data and an external signal.

At this time, the 8-bit R, G and B digital image data output from the microcomputer 20 are stored in the memory unit 40 on a frame basis, a color basis and a bit basis.

Thereafter, in the reset period and the address period of the first to eight sub-field screens (SF1 to SF8), the driving IC 33 applies an erase pulse for erasing wall charges formed in a previous field to the entire horizontal electrode lines S1 to S480 (first step). The driving IC 33 applies a write pulse for forming uniform wall charges to a three-electrode surface discharge type plasma display panel 10 (second step). The driving IC 33 applies an erase pulse again to form wall charges on the 640 R, G and B vertical electrode lines R1 to B640 so that a voltage of a subsequently applied address pulse is lowered (third step). If the scan pulses are sequentially applied to the 480 horizontal electrode lines S1 to S480 one by one according to the clock signal (CLK), the data signal (DO) and the sustain pulse (fourth step), scanning of the 480 horizontal electrode lines S1 to S480 is completed.

Furthermore, when supplying the scan pulse at the fourth step, the address driver 50 supplies each of the 640 R, G and B vertical electrode lines R1 to B640 with an address pulse (1 bit value of R, G and B digital image data) corresponding to a horizontal electrode line, which is scanned as the scan pulse is applied, in synchronization with the scan signal. Therefore, a discharge can be generated within a discharge space of each cell to which an address pulse of logic "high" is applied.

At this time, the address driver 50 disposes the 8-bit R, G and B digital image data (B1 to B8) corresponding to each cell in the form of B1→SF1, B2→SF2, . . . , B7→SF7, B8→SF8.

Meanwhile, if the address period of each of the sub-field screens (SF1 to SF8) is completed, the driving IC 33 receives a sustain pulse from the sustain pulse generator 32 and supplies the entire horizontal electrode lines S1 to S480 with a sustain pulse whose number is proportional to SF1:SF2: . . . SF7:SF8=$2^7$:$2^6$: . . . $2^1$:$2^0$ (a relative luminance ratio). That is, during a time T, the most significant bit (MSB) scans lower bits in order of bits close to the MSB, during T/2, T/4, . . . T/64, T/128, so that a discharge and emission of some cells in which a discharge has occurred in the address period is sustained during a period where the sustain pulse is supplied (the sustain period).

If the configuration of the first to eight sub-field screens (SF1 to SF8) is completed through the above process, an image of 256 gray levels is displayed on the plasma display panel 10.

Furthermore, the number of sub-fields is generally about 12. The number of gray levels that can be obtained using two sub-fields is 2. However, all of them cannot be used. This is because of pseudo contour in a motion picture, which has been a problem depending on the sub-field driving method of the plasma display panel.

If a specific combination of sub-fields for producing a lot of pseudo contour is all taken out, the number of real gray levels that can be really produced can be less than 100.

To represent gray levels higher than that using such a small gray level, another method has to be additionally used. This method is an intermediate gray level generating method called "half-toning". This method functions to fill between real gray levels.

Error diffusion or dithering is usually used. The error diffusion method is a slightly modified method of the Floyd Steinberg method. The dithering method is a cyclic repeat method on a frame cycle using a 4×4 mask.

The error diffusion method is a method of diffusing gray level error values of an input pixel into neighboring cells. This method is technology that is generally used in a printing apparatus such as a printer. More particularly, if the error diffusion method is employed in an AV motion picture, excellent representation is possible. In this method, predetermined pattern noise, which is generated due to the use of a dither, does not occur.

If a still image such as PC mode is to be displayed, however, the error diffusion method has a still noise pattern. If a luminance difference between real gray levels is high, the noise pattern is very strong. Therefore, this may result in dot noise of a pattern. More particularly, this is true of a dark screen on which low gray levels are generally displayed.

To prevent the still noise pattern from occurring, a method of adding some random noise to an image signal is generally used. If the random noise is used, the noise pattern is changed little by little every moment. This removes the dot noise of the still noise pattern. However, the noise pattern that continues to move can be seen as noises in a dark image having lots of low gray level. This may lead to a sizzling phenomenon of the screen. This cannot be avoided even if a very small amount of noise is added.

More particularly, in the plasma display panel, in the case of a screen having a low Average Picture Luminance (APL), a luminance difference between real grays is high since a lot of sustain pulses is used. Therefore, there is a problem in that the sizzling noise is very unpleasant to the eye.

SUMMARY OF THE INVENTION

Accordingly, an object of an embodiment of the present invention is to solve at least the problems and disadvantages of the background art.

It is an object of an embodiment of the present invention to enhance the capability to represent gray levels by improving an image processing apparatus and method of a plasma display panel.

It is another object of an embodiment of the present invention to prevent the sizzling of the screen from occurring through a random noise process used to prevent static error diffusion noise.

An image processing apparatus of a plasma display panel according to an embodiment of the present invention comprises an inverse gamma correction unit for gamma-correcting an image signal through previously stored gamma data, a half-toning unit for adding an error diffusion error value (Ei) of neighboring pixels to a noise value (n(i, j)) of a predetermined pattern and for diffusing the added result into the inverse gamma corrected image signal and a sub-field mapping unit for mapping the half-toned image signal to a sub-field mapping table.

In an image processing method of a plasma display panel according to an embodiment of the present invention, to maintain a noise amount to a minimum, a noise value (n(i, j)) is set to 1 or −1, and the noise value (n(i, j)) has a noise pattern comprising of the following a 4×4 matrix.

$$n(i, j) = \begin{pmatrix} 1 & -1 & 1 & -1 \\ -1 & 1 & -1 & 1 \\ 1 & -1 & 1 & -1 \\ -1 & 1 & -1 & 1 \end{pmatrix}$$

According to an embodiment of the present invention, in the case where the error diffusion method is used in the plasma display panel screen, a noise value that is repeated every frame is used. It is thus possible to prevent the sizzling of the screen from occurring through a random noise process used to prevent static error diffusion noise

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
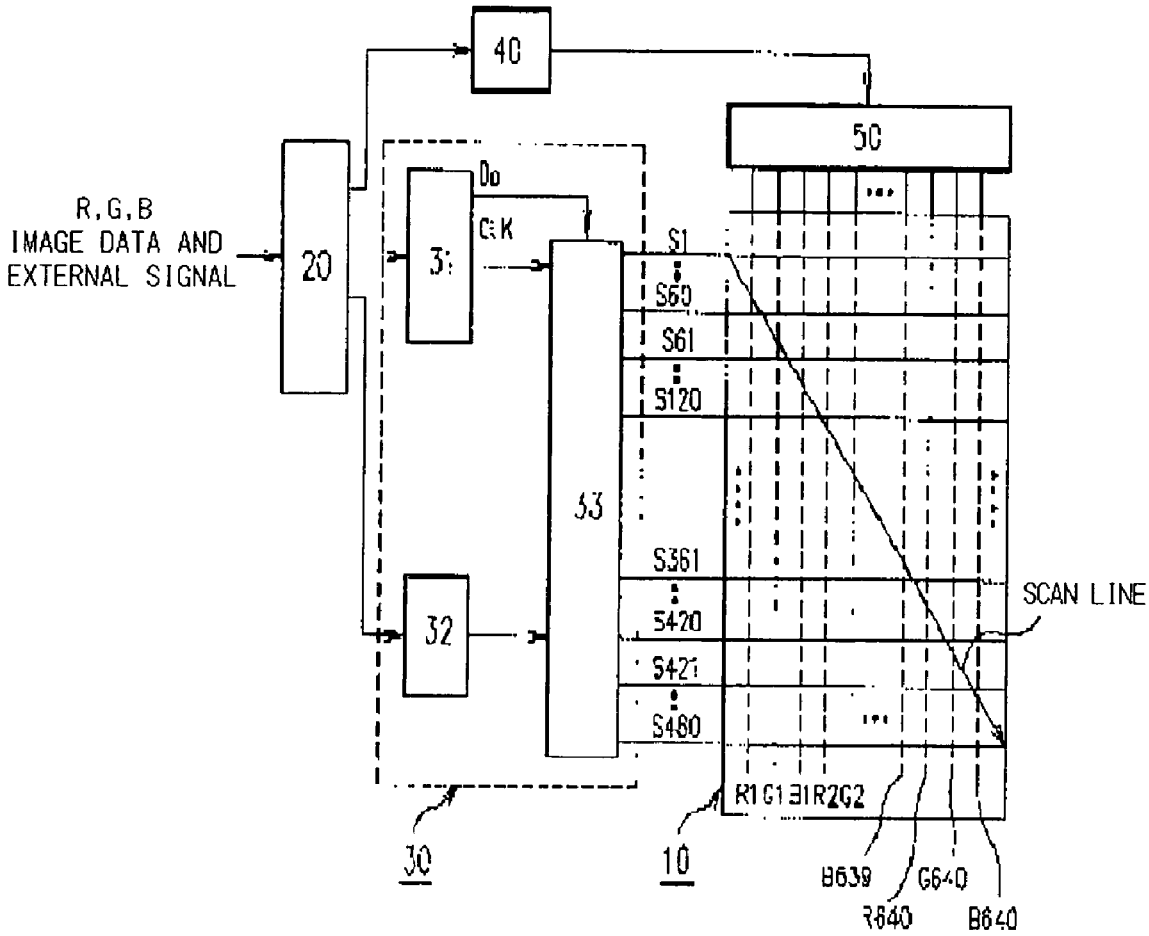
Fig. 1 RELATED ART
FIG. 1 is a schematic view illustrating a general plasma display apparatus.
Figure 2:
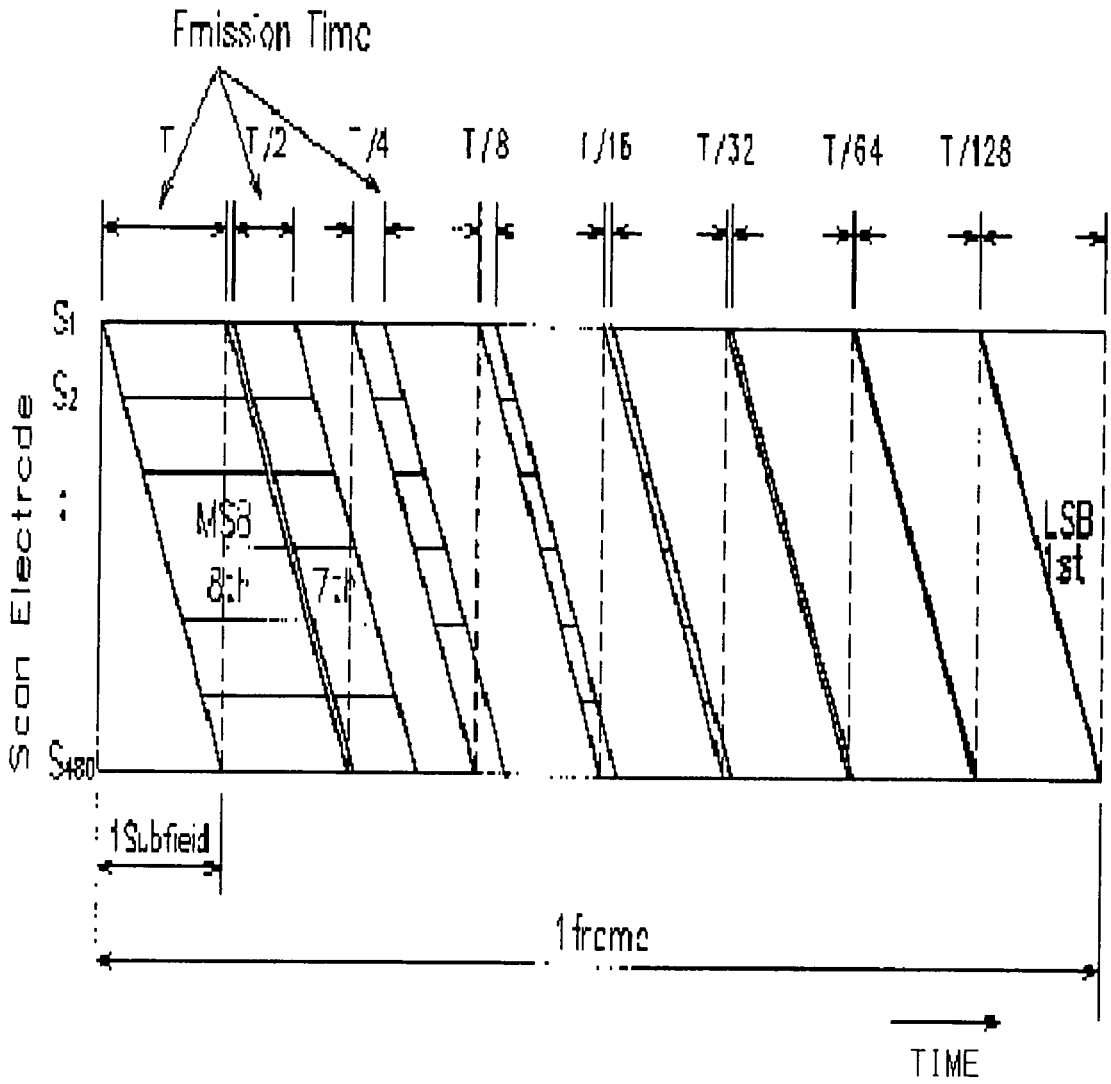
Fig. 2 RELATED ART
FIG. 2 is a view illustrating a method of implementing gray levels of an image of the plasma display apparatus in the related art.

An embodiment of the present invention will be described in a more detailed manner with reference to the drawings.

An image processing apparatus of a plasma display panel according to an embodiment of the present invention comprises an inverse gamma correction unit for gamma-correcting an image signal through previously stored gamma data, a half-toning unit for adding an error diffusion error value (Ei) of neighboring pixels to a noise value (n(i, j)) of a predetermined pattern and for diffusing the added result into the inverse gamma corrected image signal and a sub-field mapping unit for mapping the half-toned image signal to a sub-field mapping table.

The half-toning unit may comprise a noise pattern unit for outputting the noise value (n(i, j)) of "1 or "−1" as predetermined pattern, an adder for adding the noise value (n(i, j)) received from the noise pattern unit and an error diffusion error value (Ei) received from a system and for outputting the added result, an error diffusion coefficient look-up table for storing error diffusion coefficients (e1 to e4, c1 to c4) so that the sum of the error diffusion coefficients becomes "1" and an error diffusion unit for confirming the error diffusion coefficients of the error diffusion coefficient look-up table using a value received from the adder, for calculating the error diffusion coefficients and a value received from the adder, and for outputting a carry if the calculated result is a predetermined value or higher.

The noise value (n(i, j)) has a noise pattern comprising of the following 4×4 matrix.

$$n(i,\ j) = \begin{pmatrix} 1 & -1 & 1 & -1 \\ -1 & 1 & -1 & 1 \\ 1 & -1 & 1 & -1 \\ -1 & 1 & -1 & 1 \end{pmatrix}$$

The i value of the noise value (n(i, j)) is a current frame counter value.

The j value of the noise value (n(i, j)) is a x coordinate of a current pixel.

The i value is a remnant value which is the current frame counter value divided by 4 and has any one of 0, 1, 2 and 3.

The j value is a remnant value which is the current frame counter value divided by 4 and has any one of 0, 1, 2 and 3.

The error diffusion unit calculates the value received from the adder and the error diffusion coefficients of the error diffusion coefficient look-up table according to the following equations.

$$E=Ei+n+(e1\times c1)+(e2\times c1)+(e3\times c3)+(e4\times c4)$$

where c1+c2+c3+c4=1

In an image processing method of a plasma display panel according to an embodiment of the present invention, to maintain a noise amount to a minimum, a noise value (n(i, j)) is set to 1 or −1, and the noise value (n(i, j)) has a noise pattern comprising of the following a 4×4 matrix.

$$n(i,\ j) = \begin{pmatrix} 1 & -1 & 1 & -1 \\ -1 & 1 & -1 & 1 \\ 1 & -1 & 1 & -1 \\ -1 & 1 & -1 & 1 \end{pmatrix}$$

The i value of the noise value (n(i, j)) is a current frame counter value.

The j value of the noise value (n(i, j)) is a x coordinate of a current pixel.

The i value is a remnant value which is the current frame counter value divided by 4 and has any one of 0, 1, 2 and 3.

The j value is a remnant value which is the current frame counter value divided by 4 and has any one of 0, 1, 2 and 3.

A embodiment of the present invention will now be described below with reference to the accompanying drawings.

Figure 3:
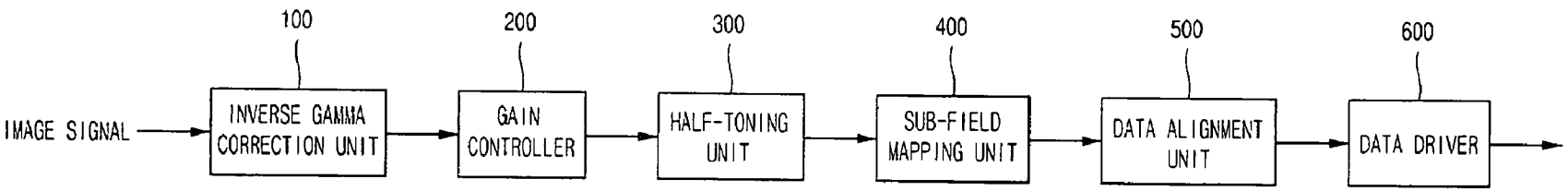
FIG. 3 is a block diagram schematically illustrating an image processing apparatus of a plasma display panel according to an embodiment of the present invention.

FIG. 3 is a block diagram schematically illustrating an image processing apparatus of a plasma display panel according to an embodiment of the present invention.

As shown in FIG. 3, the image processing apparatus of the plasma display panel according to an embodiment of the present invention comprises an inverse gamma correction unit 100, a gain controller 200, a half-toning unit 300, a sub-field mapping unit 400, a data alignment unit 500 and a data driver.

The inverse gamma correction unit 100 linearly changes a luminance value displayed depending on a gray level value of an input image signal by performing a gamma correction operation on the image signal through previously stored gamma data.

The gain controller 200 controls a gain every red, green and blue by multiplying the image signals of the red, green and blue, which are corrected by the inverse gamma correction unit 100, by a gain value that can be controlled by a user or set maker. The user or set maker can set a desired color temperature using the gain controller 200. In the present embodiment, the image processing apparatus further comprises the gain controller 200 that performs such a function.

The half-toning unit 300 performs a quantization process on the image signal received from the gain controller 200, and diffuses generated error components into neighboring pixels. Therefore, a luminance value displayed depending on a gray level value can be finely controlled, and the capability to represent gray levels can be improved accordingly. This method is called "error diffusion method". The half-toning unit may use the dithering method as well as the error diffusion method.

The half-toning unit 300 according to an embodiment of the present invention adds an error diffusion error value (Ei) of neighboring pixels to a noise value (n(i, j)) of a predetermined pattern in performing error diffusion, so that it is diffused into an inverse gamma corrected image signal. This will be described later on in more detail.

The sub-field mapping unit 400 maps the image signal, which is received from the half-toning unit 300, to a previously set sub-field mapping table.

The data alignment unit 500 aligns the sub-field mapping data, which have been received from the sub-field mapping unit 400 and are spatially aligned, as temporal data.

The data driver 600 receives data, which have been temporally aligned by the data alignment unit 500, and supplies an address driving pulse to an address electrode (not shown) of the plasma display panel, thus implementing images of the plasma display panel. The half-toning unit according to an embodiment of the present invention will be described in more detail with reference to FIG. 4.

Figure 4:
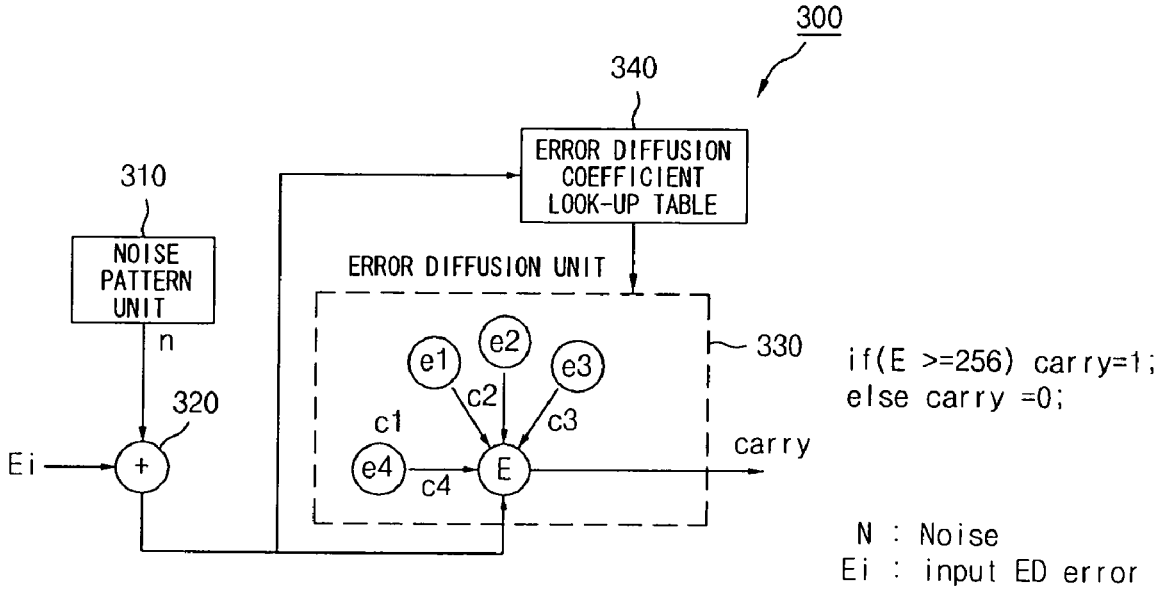
FIG. 4 is a block diagram illustrating an operating characteristic of a half-toning unit according to an embodiment of the present invention.

FIG. 4 is a block diagram illustrating an operating characteristic of a half-toning unit according to an embodiment of the present invention.

As shown in FIG. 4, a half-toning unit 300 according to an embodiment of the present invention comprises a noise pattern unit 310, an adder 320, an error diffusion unit 330 and an error diffusion coefficient look-up table 340.

The noise pattern unit 310 outputs a noise value (n(i, j)) of "1" or "−1" in order to maintain a noise amount to the minimum, but outputs the noise value (n(i, j)) so that the noise value is repeated every four frames. Therefore, the noise value has a noise pattern comprising of a 4×4 matrix as shown in the following Equation 1.

[Equation 1]

$$n(i, j) = \begin{pmatrix} 1 & -1 & 1 & -1 \\ -1 & 1 & -1 & 1 \\ 1 & -1 & 1 & -1 \\ -1 & 1 & -1 & 1 \end{pmatrix}$$

where an "i" value designates a current frame counter value and a "j" value designates a x coordinate of a current pixel.

The adder 320 adds an input error diffusion error value (Ei) and the noise value (n) output from the noise pattern unit 310, and outputs an added result.

The error diffusion coefficient look-up table 340 stores coefficient (e1 to e4, c1 to c4) so that the sum of error diffusion coefficient (e1 to e4, c1 to c4) becomes "1".

The error diffusion unit 330 confirms the error diffusion coefficient (e1 to e4, c1 to c4) of the error diffusion coefficient look-up table 340 using a value received from the adder 320, and performs an operation as shown in Equation 2 using the error diffusion coefficient (e1 to e4, c1 to c4). If the added sum (E) is 256 or higher, the error diffusion unit 330 outputs a carry.

$$E=Ei+n+(e1*c1)+(e2*c1)+(e3*c3)+(e4*c4) \quad \text{[Equation 2]}$$

Where c1+c2+c3+c4=1

Hereinafter, the operation of the half-toning unit according to an embodiment of the present invention will be described in detail with reference to FIG. 4.

Assuming that an error value of an input pixel is Ei and a noise value of the noise pattern unit 310 is n, the error value Ei and the noise value n are added in the adder 320 and are then input to the error diffusion unit 330.

The error diffusion unit 330 uses the error diffusion coefficients (e1 to e4, c1 to c4) defined by the input error value (Ei+n), and calculates the input error value (Ei+n) and the error diffusion coefficients (e1 to e4, c1 to c4) according to Equation 2. As a result of the calculation, if the result is 256 or higher, the error diffusion unit 330 generates a carry.

Meanwhile, the noise value (n) is decided by a x coordinate of a current pixel and a current frame counter value. The noise value (n) has "1" or "−1". This is for the purpose of maintaining the noise amount to a minimum. Therefore, the noise value (n) is decided by an x coordinate of a current pixel and a frame number, i.e., a frame count value. For example, when the current frame is the first, the noise value (n) is defined in order of 1, −1, 1, −1, 1, −1, 1, −1, . . . . Since a 4×4 matrix is used, the noise value (n) that is repeated every four frames is obtained.

As a result, a noise pattern which four frames are different from one another is obtained.

Therefore, when there is no pattern noise as in the present invention, a dot luminance value of a fixed noise pattern is "1", and when the noise pattern of the present invention is used, the dot luminance value becomes "¼". Therefore, there is an effect in that the noise pattern is equally distributed over quadrupled areas. A strong dot noise disappears and a smoother image can be obtained.

Accordingly, in the case where the error diffusion method is used in the plasma display panel screen, a noise value that is repeated every frame is used in the error diffusion method. It is thus possible to prevent the sizzling of the screen from occurring through a random noise process used to prevent static error diffusion noise.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image processing apparatus of a plasma display panel, comprising:

an inverse gamma correction unit for gamma-correcting an image signal through previously stored gamma data;

a half-toning unit for adding an error diffusion error value (Ei) of neighboring pixels to a noise value (n(i, j)) of a predetermined pattern and for diffusing the added result into the inverse gamma corrected image signal; and a sub-field mapping unit for mapping the half-toned image signal to a sub-field mapping table, wherein the i value of the noise value (n(i, j)) is a current frame counter value, the j value of the noise value (n(i, j)) is an x coordinate of a current pixel, and the noise value (n(i, j)) is repeated every predetermined frame, and wherein the half-toning unit comprises:

a noise pattern unit for outputting the noise value (n(i, j)) of "1 or "−1" as predetermined pattern;

an adder for adding the noise value (n(i, j)) received from the noise pattern unit and an error diffusion error value (Ei) received from a system and for outputting the added result;

an error diffusion coefficient look-up table for storing error diffusion coefficients (e1 to e4, c1 to c4) so that the sum of the error diffusion coefficients becomes "1"; and an error diffusion unit for confirming the error diffusion coefficients of the error diffusion coefficient look-up table using a value received from the adder, for calculating the error diffusion coefficients and a value received from the adder, and for outputting a carry if the calculated result is a predetermined value or higher.

2. The image processing apparatus as claimed in claim 1, wherein the noise value (n(i, j)) has a noise pattern comprising of the following 4×4 matrix.

$$n(i, j) = \begin{pmatrix} 1 & -1 & 1 & -1 \\ -1 & 1 & -1 & 1 \\ 1 & -1 & 1 & -1 \\ -1 & 1 & -1 & 1 \end{pmatrix}.$$

3. The image processing apparatus as claimed in claim 2, wherein the i value is a remnant value which is the current frame counter value divided by 4 and has any one of 0, 1, 2 and 3.

4. The image processing apparatus as claimed in claim 2, wherein the j value is a remnant value which is the current frame counter value divided by 4 and has any one of 0, 1, 2 and 3.

5. The image processing apparatus as claimed in claim 1, wherein the error diffusion unit calculates the value received from the adder and the error diffusion coefficients of the error diffusion coefficient look-up table according to the following equations $$E=Ei+n+(e1'c1)+(e2\times c1)+(e3\times c3)+(e4\times c4)$$

where c1+c2+c3+c4=1, E is a total error value, c1 to c4 are the error diffusion coefficients, e1 to e4 are error values of neighboring pixels.

6. An image processing method of a plasma display apparatus for representing gray levels, wherein to maintain a noise amount to a minimum, a noise value (n(i, j)) is set to 1 or −1, and the noise value (n(i, j)) has a noise pattern comprising of the following a 4×4 matrix, wherein the i value of the noise value (n(i, j)) is a current frame counter value, and the j value of the noise value (n(i, j)) is an x coordinate of a current pixel $$n(i, j) = \begin{pmatrix} 1 & -1 & 1 & -1 \\ -1 & 1 & -1 & 1 \\ 1 & -1 & 1 & -1 \\ -1 & 1 & -1 & 1 \end{pmatrix}.$$

7. The image processing method as claimed in claim 6, wherein the i value is a remnant value which is the current frame counter value divided by 4 and has any one of 0, 1, 2 and 3.

8. The image processing method as claimed in claim 6, wherein the j value is a remnant value which is the current frame counter value divided by 4 and has any one of 0, 1, 2 and 3.

* * * * *